US010252430B2

(12) United States Patent
Han et al.

(10) Patent No.: US 10,252,430 B2
(45) Date of Patent: Apr. 9, 2019

(54) HAIR TRIMMER AND METHOD OF USING SAME

(71) Applicant: Kiss Nail Products, Inc., Port Washington, NY (US)

(72) Inventors: Kyusang Han, Port Washington, NY (US); Sung Lyul Park, Port Washington, NY (US); Siyong Sung, Port Washington, NY (US); Jisun Lee, Port Washington, NY (US); Hyoungsub Kim, Jiangsu (CN); YoungHyuck Lee, Port Washington, NY (US); Samuel Park, Port Washington, NY (US)

(73) Assignee: Kiss Nail Products, Inc., Port Washington, NY (US)

( * ) Notice: Subject to any disclaimer, the term of this patent is extended or adjusted under 35 U.S.C. 154(b) by 0 days.

(21) Appl. No.: 15/177,083

(22) Filed: Jun. 8, 2016

(65) Prior Publication Data

US 2017/0355089 A1 Dec. 14, 2017

(51) Int. Cl.

| | |
|---|---|
| ***B26B 19/02*** | (2006.01) |
| ***B26B 19/38*** | (2006.01) |
| ***B26B 19/06*** | (2006.01) |

(52) U.S. Cl.

CPC ..... *B26B 19/3853* (2013.01); *B26B 19/06* (2013.01); *B26B 19/3873* (2013.01)

(58) Field of Classification Search

CPC ..... B26B 19/148; B26B 19/00; B26B 19/02; B26B 19/44; B26B 19/3853; B26B 19/3873

(Continued)

(56) References Cited

U.S. PATENT DOCUMENTS 558,973 A * 4/1896 Milliken ..... B26B 19/06 30/197
874,932 A * 12/1907 Brigham ..... B26B 19/36 30/218

(Continued)

FOREIGN PATENT DOCUMENTS

WO WO 2017213982 A1 * 12/2017

OTHER PUBLICATIONS

International Search Report dated Aug. 17, 2017 for International Application No. PCT/US2017/035639.

(Continued)

*Primary Examiner* — Jason Daniel Prone
(74) *Attorney, Agent, or Firm* — Venable LLP; Keith G. Haddaway; Tamatane J. Aga

(57) ABSTRACT

A hair trimmer includes a cutting head and a body configured for easy reach of the hard to reach places, such as behind ears. This is achieved by shaping a front portion of the body to have cutouts behind the cutting head, which allow the trimmer to navigate around parts such as an ear. The cutouts also improve air flow around the front of the trimmer's body, thereby improving performance and durability of internal trimmer components through better cooling. The walls of the cutouts may have air ducts to further improve the cooling of the internal components. The cutouts also reduce the vibration of the cutting head and the body, leading to better trimming experience for the user and to improved durability of the trimmer. The method of using a trimmer with a cutting head and a body configured for easy reach of hard to reach places, such as behind ears, is also described.

29 Claims, 5 Drawing Sheets

(58) Field of Classification Search
USPC ..... 30/196–210; D28/49–54
See application file for complete search history.

(56) References Cited

U.S. PATENT DOCUMENTS 1,479,302 A * 1/1924 Jones ..... B26B 19/06 30/200
1,528,430 A * 3/1925 Josten et al. ..... B26B 19/44 30/133
1,708,315 A * 4/1929 Lutes ..... B26B 19/282 200/277.2
1,987,444 A * 1/1935 Jeppsson ..... B26B 19/16 30/216
2,029,791 A * 2/1936 Pluchino ..... B26B 19/06 30/200
2,108,569 A * 2/1938 Togami ..... H02K 7/145 30/216
2,309,175 A * 1/1943 Doggett ..... B26B 19/06 30/197
2,332,557 A * 10/1943 Carillo ..... A41H 31/005 26/11
2,502,252 A * 3/1950 Faile ..... H01R 39/643 192/110 B
2,697,876 A * 12/1954 Blanchard ..... B26B 19/44 30/133
2,832,940 A * 4/1958 Furpahs ..... H01R 39/00 439/22
3,100,342 A * 8/1963 Reiner ..... B26B 19/06 30/200
3,360,762 A * 12/1967 Mohr ..... H01R 39/643 439/17
3,384,919 A * 5/1968 Jording et al. ..... B26B 19/44 30/133
3,440,681 A * 4/1969 Hixson et al. ..... B26B 19/44 30/133
3,675,323 A * 7/1972 Braginetz ..... B26B 21/06 30/32
3,878,605 A * 4/1975 Braginetz ..... B26B 21/52 30/526
4,514,904 A * 5/1985 Bond ..... B26B 21/225 30/47
4,619,044 A * 10/1986 Dennis ..... B26B 19/44 30/133
D290,531 S * 6/1987 Seiffert ..... D28/49
4,843,717 A * 7/1989 Crane ..... B26B 19/44 30/133
D302,742 S * 8/1989 Sagawa ..... D28/51
D302,743 S * 8/1989 Wahl ..... D28/53
4,894,014 A * 1/1990 Palus ..... H01R 39/643 439/17
D314,841 S * 2/1991 Locke ..... D28/49
5,060,380 A * 10/1991 Fujikawa ..... B26B 19/16 30/200
5,088,199 A * 2/1992 Romani ..... B26B 19/44 30/133
D326,930 S * 6/1992 Mauro ..... D28/50
D328,157 S * 7/1992 Lazarchik ..... D28/49
D337,176 S * 7/1993 Romani ..... D28/54
D337,857 S * 7/1993 Nakashima ..... D28/49
D341,677 S * 11/1993 van Asten ..... D28/49
5,325,589 A * 7/1994 Kubo ..... B26B 19/205 30/196
D352,132 S * 11/1994 Wagenknecht ..... D28/53
D365,890 S * 1/1996 Bone ..... D28/53
D367,945 S * 3/1996 Ullmann ..... D28/51
D371,635 S * 7/1996 Ullmann ..... D28/51
D374,501 S * 10/1996 Ullmann ..... D28/49
5,579,581 A * 12/1996 Melton ..... B26B 19/063 30/223
D387,487 S * 12/1997 Sulik ..... D28/53
D389,602 S * 1/1998 Lebherz ..... D28/51
D391,676 S * 3/1998 Sulik ..... D28/51
D422,118 S * 3/2000 Kitagawa ..... D28/51
D422,752 S * 4/2000 Pickett ..... D28/53
D439,702 S * 3/2001 Sulik ..... D28/49
D455,229 S * 4/2002 Lau ..... D28/50
D466,650 S * 12/2002 Muller ..... D28/53
D477,439 S * 7/2003 Dirks ..... D28/53
D479,364 S * 9/2003 Long ..... D28/54
D502,784 S * 3/2005 Micinilio ..... D28/50
D512,185 S * 11/2005 Bokelman-Dumas ..... D28/53
D513,343 S * 12/2005 Bokelman-Dumas ..... D28/53
D517,730 S * 3/2006 Bauwens ..... D28/53
D521,683 S * 5/2006 Pepall ..... D28/53
D522,176 S * 5/2006 Ullmann ..... D28/51
D523,991 S * 6/2006 Langley ..... D28/53
7,076,878 B2 * 7/2006 Degregorio, Jr. ..... B26B 19/44 30/133
D537,207 S * 2/2007 Wonderley ..... D28/51
D538,476 S * 3/2007 Laube ..... D28/54
7,228,630 B2 * 6/2007 Obermann ..... B26B 19/44 30/133
D546,001 S * 7/2007 McLachlan ..... D28/50
D550,901 S * 9/2007 Massee ..... D28/50
D572,863 S * 7/2008 Allende Fritsch ..... D28/53
D593,253 S * 5/2009 Tamsiran ..... D28/51
7,536,790 B2 * 5/2009 Ebenhoch ..... B26B 19/06 30/195
7,637,744 B2 * 12/2009 Singer ..... F16C 41/002 439/13
D608,053 S * 1/2010 Vetu ..... D28/50
D620,198 S * 7/2010 Nitz ..... D28/50
D620,200 S * 7/2010 Belozerova ..... D28/51
D620,642 S * 7/2010 Nitz ..... D28/50
7,762,001 B2 * 7/2010 Morisugi ..... B26B 19/3813 30/123
D621,097 S * 8/2010 Nishizawa ..... D28/51
D626,693 S * 11/2010 Harbeke ..... D28/53
D634,067 S * 3/2011 Stowers ..... D28/53
D636,125 S * 4/2011 Schulz ..... D28/53
D636,126 S * 4/2011 Schulz ..... D28/53
D637,759 S * 5/2011 Byun ..... D28/50
D645,202 S * 9/2011 Beedham ..... D28/44.1
D655,041 S * 2/2012 Grabes ..... D28/44
D664,295 S * 7/2012 Grabes ..... D28/44
D674,557 S * 1/2013 Weinberg ..... D28/53
D674,966 S * 1/2013 Wan ..... D28/53
D675,377 S * 1/2013 Boulanger ..... D28/51
D684,319 S * 6/2013 Wan ..... D28/54
8,484,853 B1 * 7/2013 Laube ..... B26B 19/44 30/133
D696,818 S * 12/2013 Konicek ..... D28/53
D697,668 S * 1/2014 Zheng ..... D28/54
D697,669 S * 1/2014 Zheng ..... D28/54
D698,080 S * 1/2014 Colin ..... D28/53
D698,081 S * 1/2014 Julemont ..... D28/53
D698,085 S * 1/2014 Yoon ..... D28/53
D698,494 S * 1/2014 Zheng ..... D28/54
D705,485 S * 5/2014 Lin ..... D28/53
8,850,707 B2 * 10/2014 Maichel ..... B26B 19/06 30/208
D717,492 S * 11/2014 Kulshreshtha ..... D28/53
D717,493 S * 11/2014 Kulshreshtha ..... D28/53
D721,204 S * 1/2015 Prat-Pfister ..... D28/50
8,931,178 B2 * 1/2015 Beam ..... B26B 19/3853 30/133
D722,202 S * 2/2015 Erickson ..... D28/54
9,038,276 B2 * 5/2015 Arndt ..... B26B 19/3866 30/208
9,132,560 B2 * 9/2015 Shimizu ..... B26B 19/063
9,300,101 B2 * 3/2016 Hayes ..... H01R 39/64
D758,660 S * 6/2016 Prat-Pfister ..... D28/50
D758,665 S * 6/2016 Skuhra ..... D28/54
9,427,879 B2 * 8/2016 Wevers ..... B26B 19/063
D787,746 S * 5/2017 Werner ..... D28/53
D789,610 S * 6/2017 Kulshreshtha ..... D28/53
D800,386 S * 10/2017 Fleming ..... D28/53
D800,389 S * 10/2017 Fleming ..... D28/53
2005/0172493 A1 * 8/2005 Fischer ..... B26B 21/38 30/45

(56) References Cited

U.S. PATENT DOCUMENTS

| | | | | |
|---|---|---|---|---|
| 2008/0295340 | A1* | 12/2008 | Carlucci | B26B 19/063 30/199 |
| 2011/0119930 | A1 | 5/2011 | Scheunert | |
| 2012/0192436 | A1 | 8/2012 | Toy | |
| 2012/0240414 | A1* | 9/2012 | Wevers | B26B 19/20 30/201 |
| 2013/0042487 | A1* | 2/2013 | Julemont | B26B 19/20 30/277.4 |
| 2013/0081277 | A1* | 4/2013 | Shimizu | B26B 19/063 30/42 |
| 2013/0081278 | A1* | 4/2013 | Shimizu | B26B 19/063 30/45 |
| 2015/0367521 | A1 | 12/2015 | Toy et al. | |
| 2016/0354938 | A1* | 12/2016 | Atkins | B26B 19/3853 30/216 |
| 2017/0028576 | A1* | 2/2017 | Sablatschan | B26B 19/042 |

OTHER PUBLICATIONS

Written Opinion dated Aug. 17, 2017 for International Application No. PCT/US2017/035639.

* cited by examiner

HAIR TRIMMER AND METHOD OF USING SAME

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A COMPACT DISK APPENDIX

Not applicable.

BACKGROUND OF THE INVENTION

1. Field of the Invention

The following description relates to a hair trimmer including a body and a cutting head. Also, a method of using a hair trimmer is described. For example, a hair trimmer used for removing unwanted hair from difficult to reach regions is described.

2. Related Art

Hair trimmers are typically used by consumers for a number of different applications such as trimming moustaches, nose hair, hair on the temples, hair behind the ears, and other hair. One example of a hair trimmer is a facial hair trimmer. In using a hair trimmer, the user typically purchases the trimmer that includes a removable cutting head, and then uses the trimmer on a daily, weekly, or other regular interval. Cutting heads may be sold separately and may need to be replaced once the original cutting head becomes dull.

After each use of the hair trimmer, some maintenance steps may be performed, which include cleaning the cutting head with a brush or under a stream of running water. A trimmer brush is sometimes provided for cleaning the cutting head of the trimmer. The motor in the body of the trimmer may need to cool off between consecutive applications of the trimmer. The trimmer may be corded or cordless. A cordless trimmer typically has batteries, which may need to be replaced or recharged when they drain out. A corded trimmer may need to be plugged into an electric outlet to be charged.

Typically, the body of a hair trimmer is separate from the trimmer head and used to control the trimmer head for trimming a users hair. The body of a trimmer is typically a long extension in a longitudinal direction that is grasped by the user. Because a trimmer body is relatively large and long as compared to a trimmer head, the trimmer body may prevent the trimmer head from trimming unwanted hair in difficult to reach regions.

SUMMARY OF THE INVENTION

In an aspect, a device for trimming hair includes a body including a front portion, a first cutout, and a second cutout, the first cutout and the second cutout positioned at the front portion of the body, and a cutting head attached to the front portion of the body.

In another aspect, a device for trimming hair includes a body with a front portion and a back portion on two opposite ends of a length of the body, a top portion and a bottom portion on two opposite ends of a height of a body, and a left portion and a right portion on two opposite ends of a width of the body, and a cutting head attached to the front portion including a stationary blade and a moving blade, each of the blades including teeth extending substantially perpendicular to the top portion, where the body has a first depression extending inward from a position defined by the front portion, the top portion, and the left portion, and a second depression extending inward from a position defined by the front portion, the top portion, and the right portion.

In an additional aspect, a hair trimmer includes a body including a front end, and a cutting head attached to the front end of the body and including teeth along one edge of the cutting head, where the front end is configured to allow the cutting head of the trimmer to reach regions behind a user's ear.

In yet another aspect, a method for trimming hair includes providing a hair trimmer including a body having a front portion and a back portion on two opposite ends of a length of the body, a top portion and a bottom portion on two opposite ends of a height of the body, and a left portion and a right portion on two opposite ends of a width of the body, and a cutting head attached to the front portion comprising a stationary blade and a moving blade, each of the blades comprising teeth extending substantially perpendicular to the top portion, where the body has a first depression extending inward from a position defined by the front portion, the top portion, and the left portion, and a second depression extending inward from a position defined by the front portion, the top portion, and the right portion, positioning the trimmer proximate to an area to be trimmed such that a portion of a user's body extends within the first depression or the second depression, and trimming the hair.

DESCRIPTION OF THE SEVERAL VIEWS OF THE DRAWINGS

The foregoing summary, as well as the following detailed description, will be better understood when read in conjunction with the appended drawings. For the purpose of illustration, there are shown in the drawings certain embodiments of the present disclosure. It should be understood, however, that the invention is not limited to the precise arrangements and instrumentalities shown. The accompanying drawings, which are incorporated in and constitute a part of this specification, illustrate an implementation of systems and apparatuses consistent with the present invention and, together with the description, serve to explain advantages and principles consistent with the invention.

DETAILED DESCRIPTION OF THE INVENTION

Figure 2:
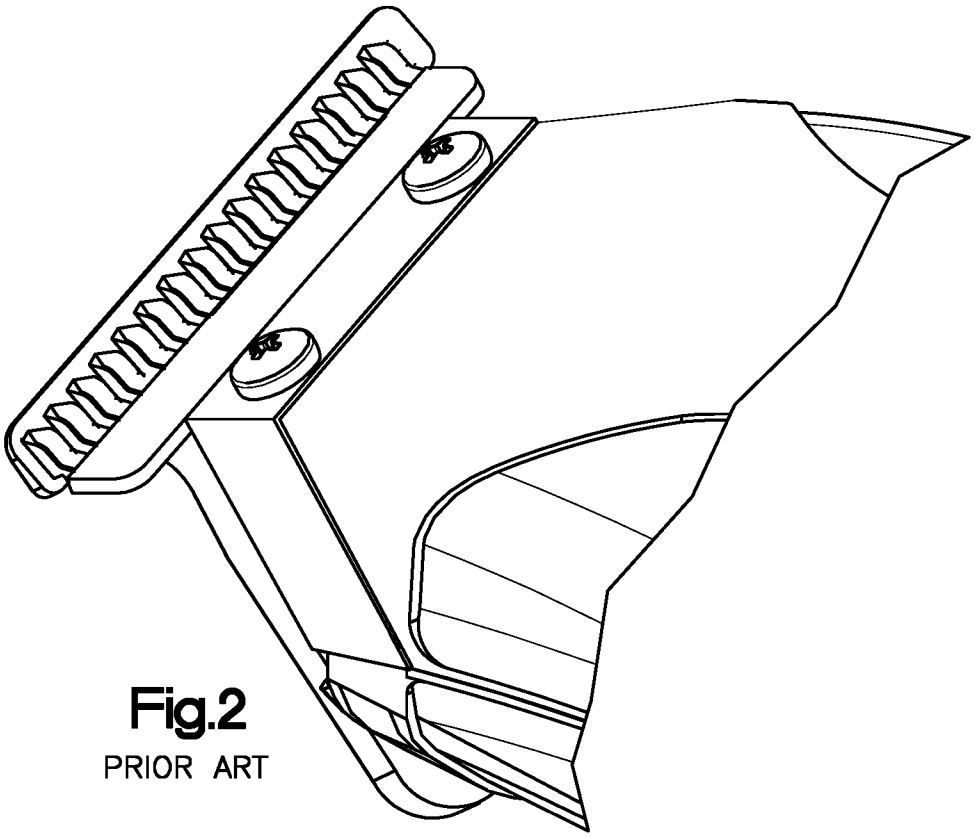
Fig.2 PRIOR ART
FIG. 2 is a diagram illustrating a top view of a prior art hair trimmer.

Before explaining at least one example of the invention in detail, it is to be understood that the invention is not limited in its application to the details of construction and to the arrangements of the components set forth in the following description or illustrated in the drawings. The Figures and written description are provided to teach any person skilled in the art to make and use the inventions for which patent protection is sought. The invention is capable of other embodiments and of being practiced and carried out in various ways. Those skilled in the art will appreciate that not all features of a commercial embodiment are shown for the sake of clarity and understanding. Persons of skill in the art will also appreciate that the development of an actual commercial embodiment incorporating aspects of the present inventions will require numerous implementation—specific decisions to achieve the developer's ultimate goal for the commercial embodiment. While these efforts may be complex and time-consuming, these efforts nevertheless would be a routine undertaking for those of skill in the art having the benefit of this disclosure.

In addition, it is to be understood that the phraseology and terminology employed herein are for the purpose of description and should not be regarded as limiting. For example, the use of a singular term, such as, "a" is not intended as limiting of the number of items. Also the use of relational terms, such as but not limited to, "top," "bottom," "left," "right," "upper," "lower," "down," "up," "side," are used in the description for clarity in specific reference to the Figures and are not intended to limit the scope of the invention or the appended claims. Further, it should be understood that any one of the features of the invention may be used separately or in combination with other features. Other systems, methods, features, and advantages of the invention will be or become apparent to one with skill in the art upon examination of the Figures and the detailed description. It is intended that all such additional systems, methods, features, and advantages be included within this description, be within the scope of the present invention, and be protected by the accompanying claims.

Figure 1:
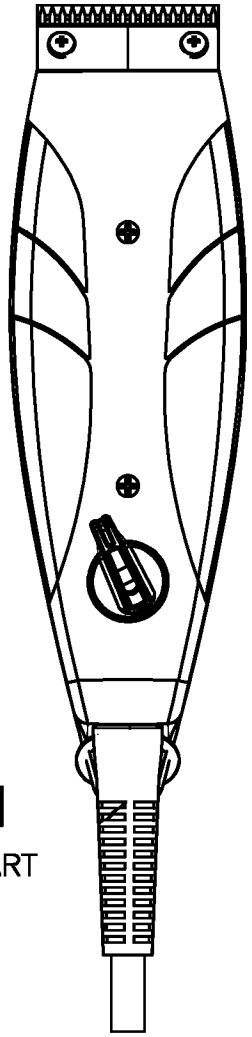
Fig.1 PRIOR ART
FIG. 1 is a diagram illustrating a top view of a prior art hair trimmer.

FIG. 1 is a diagram illustrating a top view of an example of a prior art hair trimmer. This trimmer shape, sometimes referred to as a "square blade trimmer," represents an elongated body of the trimmer connected at one of its ends to a cutting head. In this prior art hair trimmer, the width of the cutting head is slightly larger than the width of the body at the front end, or the end that is connected to the cutting head. Also, the connection between the body and the cutting head is smooth, such that the front end of the body smoothly transitions to the side of the cutting head that is attached to the body. In this trimmer, substantially the whole width of the body at the front end is in contact with the cutting head, and substantially the whole width of the cutting head is in contact with the front end of the body.

FIG. 2 is a diagram illustrating a top view of another example of a prior art hair trimmer. This trimmer shape, sometimes referred to as a "T-trimmer," represents an elongated body of the trimmer connected at its front end to a cutting head. In this example, the width of the cutting head is slightly larger than the width of the side of the body that is connected to the cutting head. In this example, the connection between the body and the cutting head is abrupt, such that the body abuts the side of the cutting head that is attached to the body, but the transition between the body and the cutting head is not smooth because the cutting head is wider than the mating part of the body. In this example, substantially the whole width of the body at the front end is in contact with the cutting head, but not the whole width of the cutting head is in contact with the body because the outside portions of the cutting head protrude beyond the width of the body.

Figure 3:
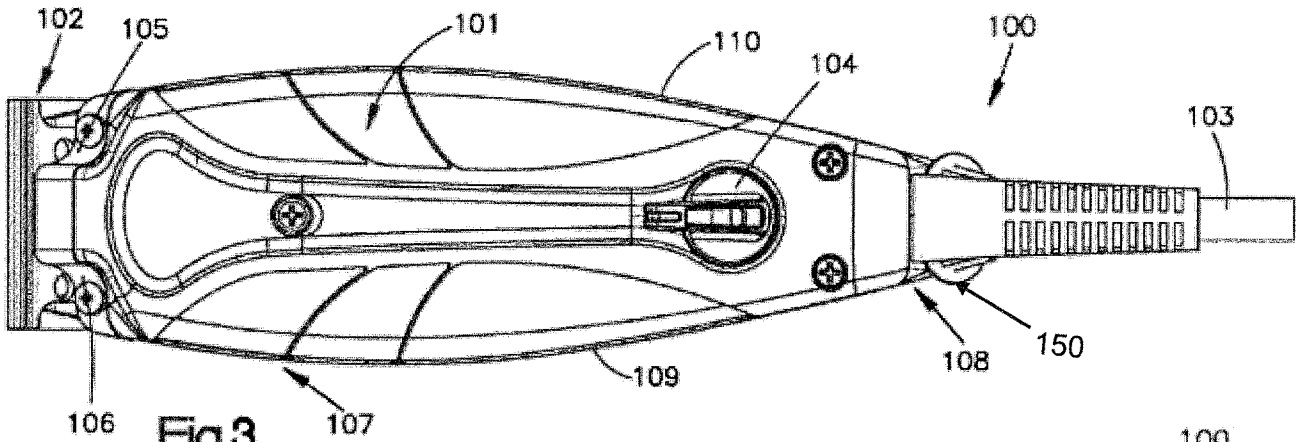
FIG. 3 is a diagram illustrating a top view of an example of a hair trimmer for trimming hair in difficult to reach regions.

FIG. 3 is a diagram illustrating a top view of an example of a hair trimmer 100 for trimming hair in difficult to reach regions. In this example, when viewing starting from a cord 103 toward a cutting head 102, trimmer 100 includes a body 101 and the cutting head 102. The trimmer 100 also includes the cord 103. The body 101 includes a front portion 107 and a back portion 108. The front portion 107 and the back portion 108 are located at opposite ends of the length of the body 101. The body 101 includes a left portion 109 and a right portion 110. The left portion 109 and the right portion 110 are located at opposite ends of the width of the body 101. The body 101 further includes a switch 104 for turning on the trimmer 100. In a preferred example, the cutting head 102 is attached to the body 101 at its front portion 107, and the cord 103 is attached to the body 101 at its back portion 108. In some examples, the front portion 107 of the body 101 comprises cutouts. The body 101 may include one or more cutouts at different regions of the body 101, and in the preferred example illustrated in FIG. 3, there are two cutouts 105 and 106. The left cutout 106 is on the left portion 109 of the body 101, and the right cutout 105 is on the right portion 110 of the body 101.

Figure 4:
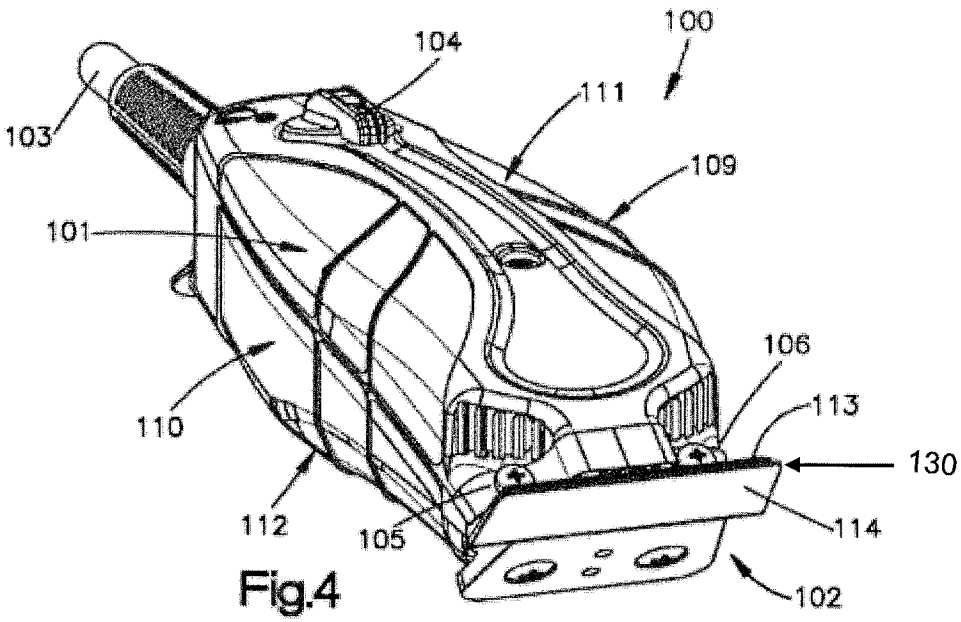
FIG. 4 is a diagram illustrating a first perspective view of an example of the hair trimmer for trimming hair in difficult to reach regions.

FIG. 4 is a diagram illustrating a perspective view of an example of the hair trimmer 100 with the right cutout 105 and the left cutout 106. When viewing starting from the cord 103 toward the cutting head 102 and an orientation in an upright state, the body 101 includes a top portion 111 and a bottom portion 112. The top portion 111 and the bottom portion 112 are located at the opposite ends of the height of the body 101. In an example, the switch 104 is located on the top portion 111 of the body 101. In this example, the cutting head 102 includes a moving blade 113 and a stationary blade 114, each of which can have teeth 130. The moving blade 113 is located on the side of the cutting head 102 that faces the body 101. The stationary blade 114 is located on the side of the cutting head 102 that faces away from the body 101. The moving blade 113 may be capable of moving back and forth in its plane, along the line generally parallel to the width of the body 101.

Figure 5:
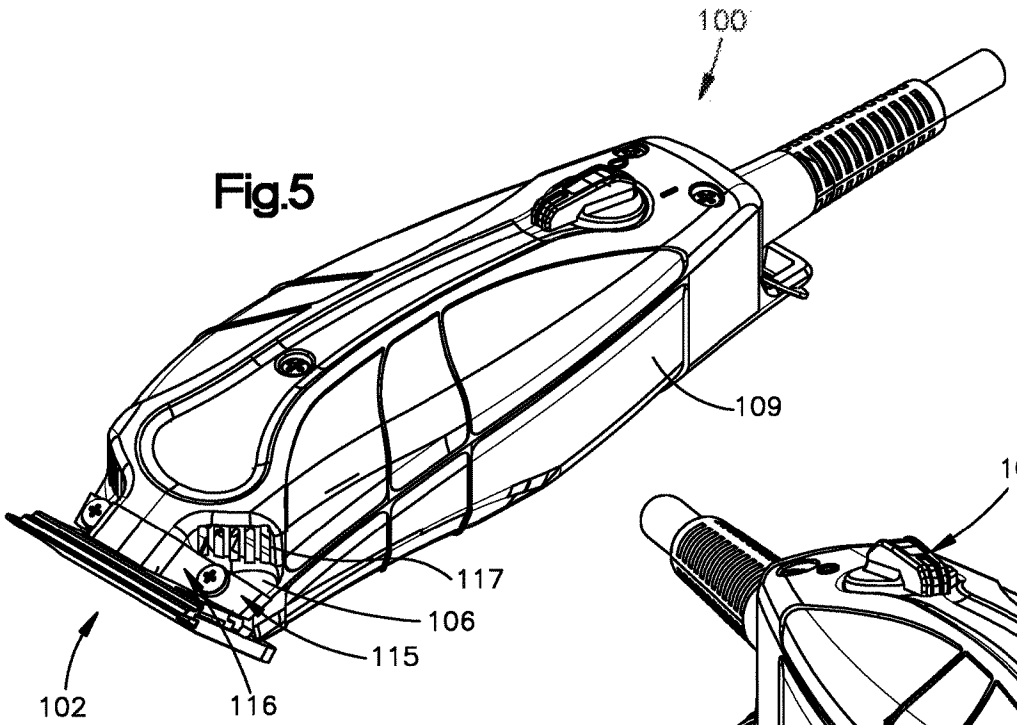
FIG. 5 is a diagram illustrating an opposite perspective view of an example of the hair trimmer for trimming hair in difficult to reach regions.
Figure 6:
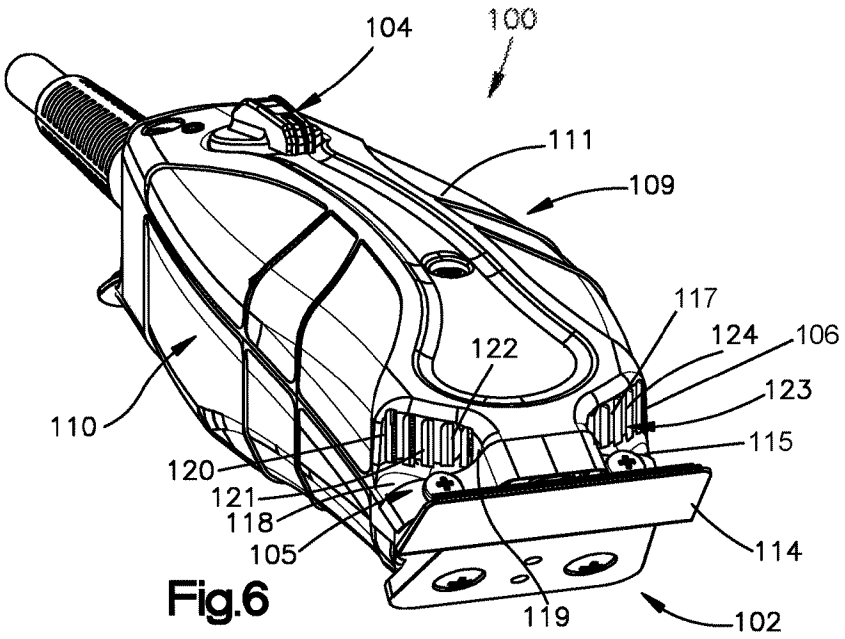
FIG. 6 is a diagram illustrating the first perspective view of the example of the hair trimmer including a right cutout and air ducts.

FIGS. 5 and 6 are diagrams illustrating perspective views of an example of the hair trimmer with elements of the cutouts 105 and 106 in an orientation in an upright state when viewing starting from the cord toward the cutting head 102. Referring to FIG. 5, some elements of the left cutout 106 are illustrated. In an example, the left cutout 106 comprises a bottom surface 115. In this example, the left cutout 106 comprises a side surface 116. In this example, the left cutout 106 comprises a back surface 117. The bottom surface 115 is generally parallel to the top portion 111 and the bottom portion 112 of the body 101. The side surface 116 is generally parallel to the left portion 109 and the right portion 110 of the body 101. The side surface 116 is generally perpendicular to the bottom surface 115. The back surface 117 is generally perpendicular to the bottom surface 115. The back surface 117 extends from the side surface 116 of the left cutout 106 to the left portion 109 of the body 101. An angle between the side surface 116 and the back surface 117 is obtuse such that the farther it is from the side surface 116, the larger is a distance between the back surface 117 and the cutting head 102.

Referring to FIG. 6, some elements of the right cutout 105 are illustrated. In an example, when viewing starting from the cord toward the cutting head 102, the right cutout 105 includes a bottom surface 118. In this example, the right cutout 105 includes a side surface 119. The right cutout 105 includes a back surface 120. The bottom surface 118 is generally parallel to the top portion 111 and the bottom portion 112 of the body 101. The side surface 119 is generally parallel to the left portion 109 and the right portion 110 of the body 101. The side surface 119 is generally perpendicular to the bottom surface 118. The back surface 120 is generally perpendicular to the bottom surface 118. The back surface 120 extends from the side surface 119 of the right cutout 105 to the right portion 110 of the body 101. An angle between the side surface 119 and the back surface 120 is obtuse such that the farther it is from the side surface 119, the larger is a distance between the back surface 120 and the cutting head 102.

In an example, the body 101 is substantially cylindrical, such that the front portion 107 and the back portion 108 are the ends of the cylindrical shape of the body, and the left portion 109, the right portion 110, the top portion 111, and the bottom portion 112 are various portions of the curved surface of a cylindrical shape of the body. In this example, the right cutout 105 extends inward from a position at the intersection of the front, right, and top portions of the body, and the left cutout 106 extends inward from a position at the intersection of the front, left, and top portions of the body.

In some examples, cross-sections of the body 101 perpendicular to a longitudinal axis of the body are substantially rectangular, or substantially circular, or substantially oval, such that the cross-sectional shape and size may vary along the length of the body.

Figure 7A:
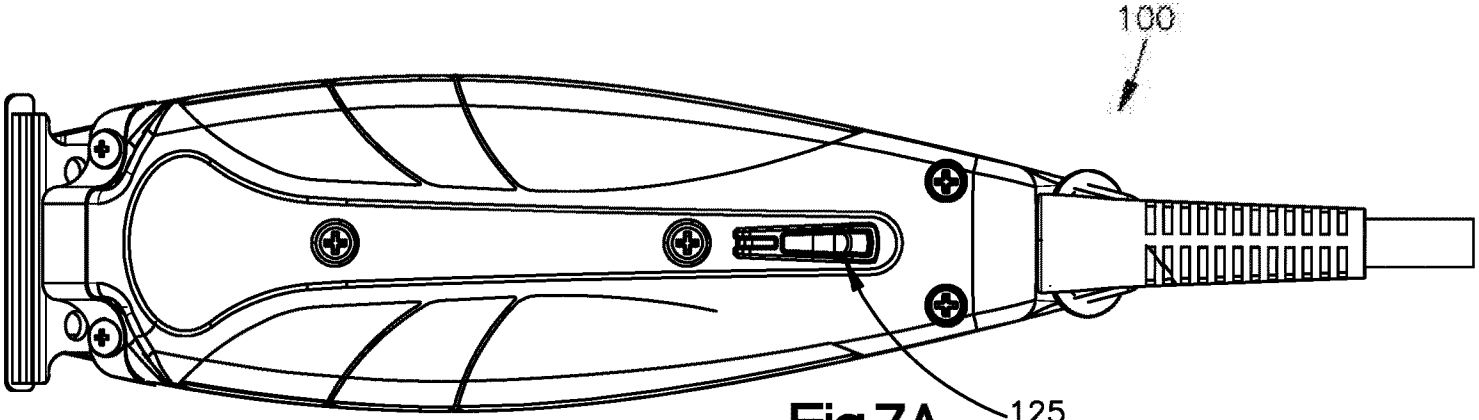
FIGS. 7A and 7B are diagrams illustrating a top view of two examples of a hair trimmer with different examples of switches.
Figure 7B:
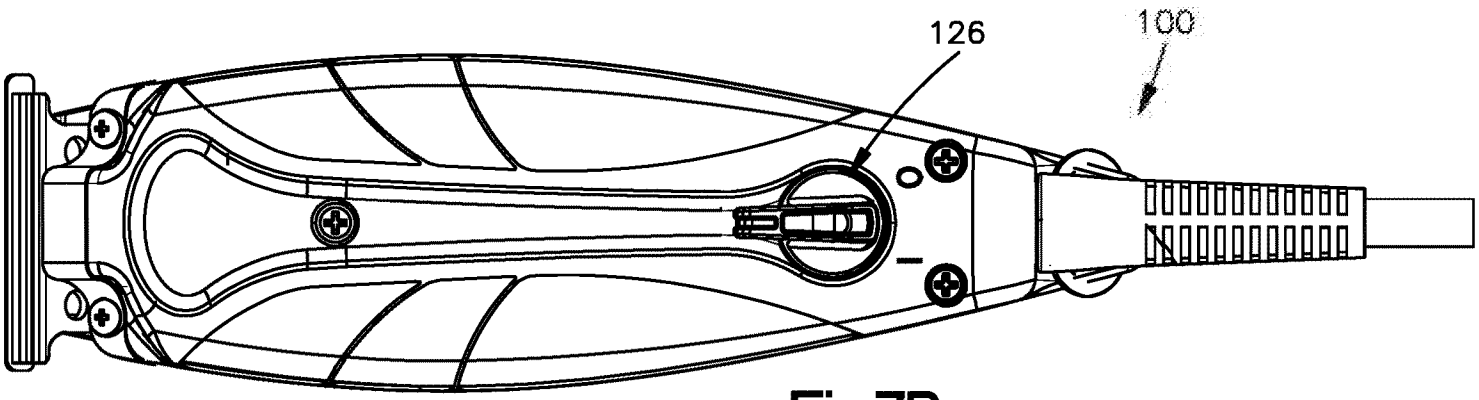

FIG. 7 is a diagram illustrating a top view of two examples of a hair trimmer with examples of switches. In an example, the switch 104 is a sliding switch 125 as illustrated in FIG. 7(*a*). In another example, the switch 104 is a turning switch 126 as illustrated in FIG. 7(*b*).

Figure 8:
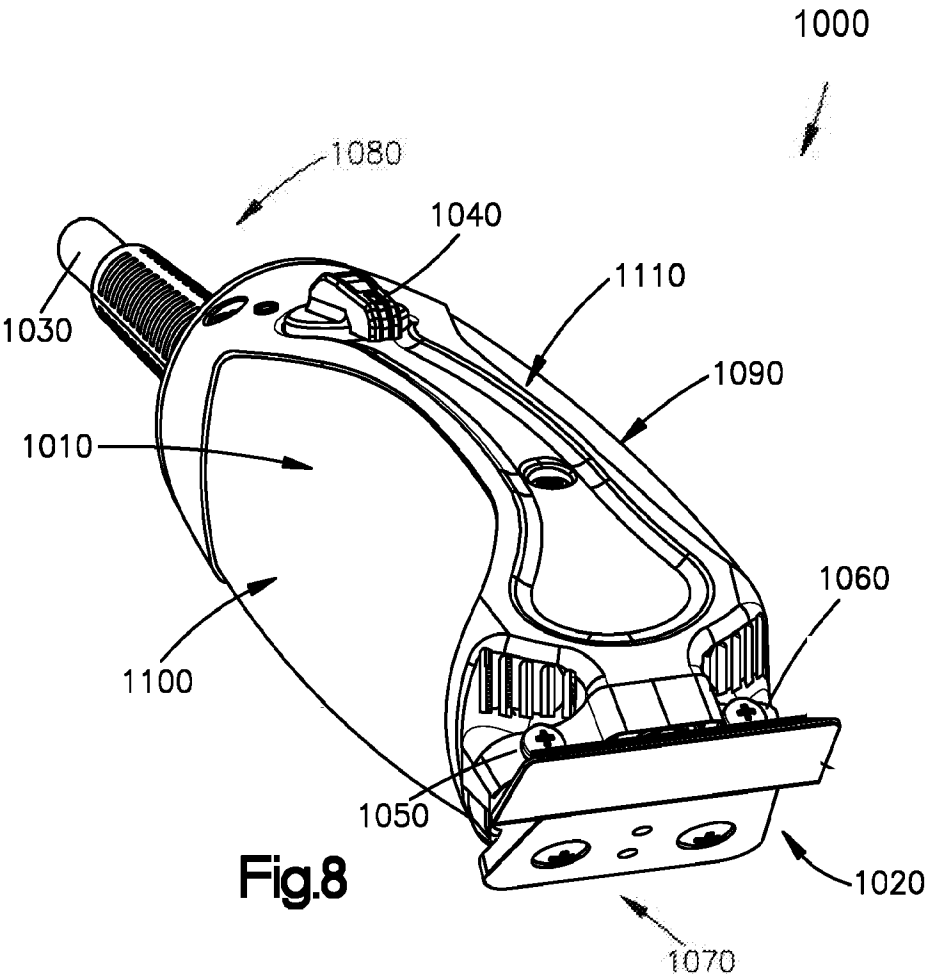
FIG. 8 is a diagram illustrating another example of a hair trimmer for trimming hair in difficult to reach regions.

FIG. 8 is a diagram illustrating another example of a hair trimmer 1000 for trimming hair in difficult to reach regions. Referring to FIG. 8, a hair trimmer 1000 for trimming hair in difficult to reach regions may have a cylindrical or other shape. For example, the trimmer 1000 includes a body 1010 having the shape of an elongated cylinder and a cutting head 1020. The trimmer 1000 also includes a cord 1030. The body 1010, when viewing in an orientation in an upright state, includes a front portion 1070 and a back portion 1080. The front portion 1070 and the back portion 1080 are located at opposite ends of the length of the body 1010. The body 1010 includes a left portion 1090 and a right portion 1100. The left portion 1090 and the right portion 1100 are located at opposite ends of the width of the body 1010. The body 1010 may further includes a switch for turning on the trimmer 1000. In a preferred example, the cutting head 1020 is attached to the body 1010 at its front portion 1070, and the cord 1030 is attached to the body 1010 at its back portion 1080. In some examples, the front portion 1070 of the body 1010 includes cutouts 1050, 1060. The body 1010 may include one or more cutouts at different regions of the body 1010, and in the preferred example illustrated in FIG. 3, there are two cutouts 1050 and 1060. The left cutout 1060 is on the left side 1090 of the body 1010, and the right cutout 1050 is on the right side 1100 of the body 1010. The cutting head 1020 may be secured to the body 1010 using a fastening element that is secured by one or more screws. The fastening element extends across the top surface of the trimmer 1000 from the right cutout 1050 to a middle protruding portion to the left cutout 1060, and the screws may be positioned within the right cutout 1050 and the left cutout 1060.

While the examples of the trimmer 100, 1000 described include a cuboidal shape and a cylindrical shape, the invention is not limited to such shapes. Other well known shapes for a hair trimmer 100, 1000 are also included and described to a person having ordinary skill in the art, and may be modified to include such cutouts 105, 1050, 106, 1060 at a front portion of the body 101 as described herein. In the above examples, the cutouts 105, 1050, 106, 1060 allow for cutting hair in hard to reach places, such as behind ears. The cutouts 105, 1050, 106, 1060 create a gap between the cutting head of the trimmer and the trimmer's body, such that an ear or another part may be partially positioned in these gaps while the cutting head reaches the hair that is being trimmed. Without the cutouts, trimming hair in such places would be difficult, or would only be accomplished with an inconvenience or pain of the user.

In an example, the cutouts 105, 1050, 106, 1060 create air pockets between the cutting head of the trimmer and the trimmer's body, such that the internal components of the trimmer are better cooled. Typically, the internal components of the trimmer such as a motor, an electromagnetic coil, or other internal components, become hot during normal operating duty cycle of the trimmer, and may overheat in case of a long continuous operation. This leads to degradation of trimmer's performance or premature failure. In an example, the air pockets created by the cutouts 105, 1050, 106, 1060 lead to lower operating temperatures of the internal components of the trimmer, or improvements in their performance, or extension of their useful life.

In an example, the cutouts 105, 1050, 106, 1060 allow for a reduced vibration of the cutting head of the trimmer and of the trimmer's body. Reduced vibration of the cutting head allows for more precise and more comfortable trimming action. Reduced vibration of the trimmer's body allows for more comfortable handling of the trimmer.

In an example, the trimmer is operated without a cord. In another example, the trimmer operates with a cord 103. In this example, the trimmer 100 may operate with the cord 103 having a swivel cord 150 that is configured to swivel around its own axis while maintaining electrical contact with the trimmer's body 100. Such swivel action of the cord 103 allows for the user to use the trimmer at various portions of their face without creating kinks in the cord 103. This leads to increased operating life of a trimmer equipped with a cord.

In an example, a method of using a hair trimmer is provided. In this example, a method of using a hair trimmer includes providing a trimmer, turning on the trimmer, positioning the trimmer in such a way that the cutting head is located in close proximity to the unwanted hair, and trimming the unwanted hair. In another example, a method of using a hair trimmer includes positioning the trimmer in such a way that the cutting head is located in close proximity to the unwanted hair, turning on the trimmer, and trimming the unwanted hair. In an example, a method of using a hair trimmer includes providing a trimmer that has a cutting head attached to a body where the body is configured with cutouts on the side of the body located next to the cutting head.

In an example, a method of trimming hair is provided. In this example, a method of trimming hair includes turning on the trimmer, positioning the trimmer in such a way that the cutting head is located in close proximity to the unwanted hair, and trimming the unwanted hair. In another example, a method of trimming hair includes positioning the trimmer in such a way that the cutting head is located in close proximity to the unwanted hair, turning on the trimmer, and trimming the unwanted hair. In an example, a method of trimming hair includes providing a trimmer that has a cutting head attached to a body where the body is configured with cutouts on the side of the body located next to the cutting head.

A hair trimmer provided herein has significant advantages over the prior art hair trimmers. It may provide better access to some unwanted hair, it may provide access to previously inaccessible unwanted hair, it may reduce a discomfort of trimming hair, it may eliminate a discomfort of trimming hair, it may lower operating temperatures of the trimmer, it may lower operating temperatures of internal components of the trimmer, it may lower surface temperatures of the trimmer's body, it may lower operating temperatures of the cutting head, it may allow for lower weight of the trimmer, it may allow for use of stronger, or less expensive, or lighter weight, materials in the construction of the trimmer, it may reduce the vibration of the trimmer, it may allow for use of more durable, or less expensive, or lighter weight, internal and external components of the trimmer, it may reduce the vibration of the trimmer body, it may reduce vibration of the cutting head, it may reduce the vibration of internal components of the trimmer, it may reduce operating noise of the trimmer, it may increase durability of the trimmer, it may increase durability of the cutting head, it may increase durability of internal components of the trimmer, it may increase time between changes of the cutting head, it may increase time between changes of trimmer battery, it may extend time the trimmer can operate on a single charge, it may decrease need for maintenance of the trimmer. While several advantages are described, it should be appreciated by one of ordinary skill in the art that the advantages of the hair trimmer are not limited to those described herein.

A trimmer body may be made of various materials including metal, plastic, resin, wood, or a combination thereof. A cutting head may be made of various materials including metal, plastic, resin, wood, or a combination thereof. A cord may be made of various materials including plastic, resin, or a combination thereof. The materials are not limited to those described herein.

A trimmer may be battery operated or electric outlet power operated, or both. A battery operated trimmer may have one or more batteries that need to be exchanged to new batteries when the previous set of batteries runs out of energy. A battery operated trimmer may have rechargeable batteries that may be recharged and reused. A battery operated trimmer may have continuously rechargeable batteries that recharge by induction charging or another continuously charging method. A trimmer that operates on electric outlet power may have a cord for connecting the trimmer to an electric power outlet.

It will be appreciated by those skilled in the art that changes could be made to the embodiments described above without departing from the broad inventive concept thereof. It is understood, therefore, that the invention disclosed herein is not limited to the particular embodiments disclosed, but it is intended to cover modifications within the spirit and scope of the present invention as defined by the appended claims.

What is claimed is:

1. A device for trimming hair, comprising:

a body comprising a front portion, a first cutout, and a second cutout, the first cutout and the second cutout positioned at the front portion of the body;

a plurality of air ducts provided in at least one of the first cutout or the second cutout, wherein the plurality of air ducts include bores extending from the front portion of the body into an internal section of the body, and facilitating cooling of internal components provided in the interior section of the body; and a cutting head attached to the front portion of the body.

2. The device of claim 1, wherein the body further comprises, when in an upright state:

a top portion and a bottom portion on two opposite ends of a height of the body;

a left portion and a right portion on two opposite ends of a width of the body; and a back portion, such that the front portion and the back portion are on two opposite ends of a length of the body, wherein the first cutout extends inward from a position defined by the front portion, the top portion, and the left portion, and the second cutout extends inward from a position defined by the front portion, the top portion, and the right portion.

3. The device of claim 2, further comprising an electric cord attached to the back portion of the body.

4. The device of claim 3, wherein the electric cord is a swivel cord.

5. The device of claim 2, wherein the internal section of the body is provided between the top portion and the bottom portion of the body.

6. The device of claim 1, wherein the bores of the plurality of air ducts extend through a back surface defined in the at least one of the first cutout or the second cutout.

7. The device of claim 6, wherein the bores of the plurality of air ducts are oriented substantially perpendicular to a bottom surface defined in the at least one of the first cutout or the second cutout.

8. The device of claim 1, wherein the cutting head comprises a stationary blade and a moving blade.

9. The device of claim 8, wherein each of the blades comprises teeth.

10. The device of claim 1, wherein the body has a cylindrical shape.

11. The device of claim 1, wherein each of the first cutout and the second cutout comprises at least one surface and wherein the bores of the plurality of air ducts are provided in the at least one surface of the at least one of the first cutout or the second cutout.

12. The device of claim 11, wherein the cutting head comprises a stationary blade and a moving blade.

13. The device of claim 12, wherein each of the blades comprises teeth.

14. The device of claim 1, wherein the bores of the plurality of air ducts facilitate ventilation of the internal components in the body.

15. A device for trimming hair, comprising:

a body including, in an upright state, a front portion and a back portion provided on two opposite ends of a length of the body, a top portion and a bottom portion on two opposite ends of a height of a body, and a left portion and a right portion on two opposite ends of a width of the body, the body defining a plane between the front and back portions;

a plurality of air ducts positioned; and a cutting head attached to the front portion comprising a stationary blade and a moving blade, each of the blades comprising teeth, wherein the body has a first depression extending inward from a position defined by the front portion, the top portion, and the left portion, and a second depression extending inward from a position defined by the front portion, the top portion, and the right portion, wherein the plurality of the air ducts are provided in at least one of the first depression or the second depression, and wherein the plurality of air ducts include bores extending from the front portion of the body into an internal section of the body, and facilitating cooling of internal components provided in the interior section of the body.

16. The device of claim 15, wherein the internal section of the body is provided between the top portion and the bottom portion of the body.

17. The device of claim 15, wherein the bores of the plurality of air ducts extend through a back surface defined in the at least one of the first depression or the second depression.

18. The device of claim 6, wherein the bores of the plurality of air ducts are oriented substantially perpendicular to a bottom surface defined in the at least one of the first depression or the second depression.

19. The device of claim 15, further comprising an electric cord attached to the back portion of the body.

20. The device of claim 19, wherein the electric cord is a swivel cord.

21. The device of claim 15, wherein at least one of the blades extends beyond the right portion and the left portion of the body at the front portion of the body.

22. The device of claim 15, wherein the bores of the plurality of air ducts facilitate ventilation of the internal components in the body.

23. A hair trimmer, comprising:

a body comprising a front portion which has at least one cutout;

a plurality of air ducts provided in the at least one cutout; and a cutting head attached to the front portion of the body and comprising teeth along one edge of the cutting head, wherein the plurality of air ducts include bores extending from the front portion of the body into an internal section of the body, and facilitating cooling of internal components provided in the interior section of the body.

24. The trimmer of claim 23, wherein the at least one cutout includes a plurality of cutouts, and wherein the front portion comprises the plurality of cutouts at two adjacent positions of the front portion of the body.

25. The trimmer of claim 23, wherein the bores of the plurality of air ducts enable ventilation of the body.

26. The trimmer of claim 23, further comprising an electric cord attached to, in the upright state, a back portion of the body.

27. The trimmer of claim 26, wherein the electric cord is a swivel cord.

28. A method for trimming hair, comprising the steps of:

providing a hair trimmer comprising:

a body having, in an upright state, a front portion and a back portion on two opposite ends of a length of the body, a top portion and a bottom portion on two opposite ends of a height of the body, and a left portion and a right portion on two opposite ends of a width of the body; and a cutting head attached to the front portion comprising a stationary blade and a moving blade, each of the blades comprising teeth extending substantially perpendicular to the top portion, wherein the body has a first depression extending inward from a position defined by the front portion, the top portion, and the left portion, and a second depression extending inward from a position defined by the front portion, the top portion, and the right portion, wherein at least one of the first depression or the second depression has a plurality of air ducts provided therein, and wherein the plurality of air ducts include bores extending from the front portion of the body into an internal section of the body, and facilitating cooling of internal components provided in the interior section of the body;

positioning the trimmer proximate to an area to be trimmed such that a portion of a user's body extends within the first depression or the second depression; and trimming the hair.

29. The device of claim 28, wherein the bores of the plurality of air ducts comprise facilitate ventilation of the internal components in the body.

* * * * *